US007389151B2

(12) United States Patent
Badami et al.

(10) Patent No.: US 7,389,151 B2
(45) Date of Patent: Jun. 17, 2008

(54) SYSTEMS AND METHODS FOR MULTI-LEVEL OPTIMIZING CONTROL SYSTEMS FOR BOILERS

(75) Inventors: Vivek Venugopal Badami, Schenectady, NY (US); Rajesh Venkat Subbu, Clifton Park, NY (US); Avinash Vinayak Taware, Niskayuna, NY (US); Piero Patrone Bonissone, Schenectady, NY (US); Neil Colin Widmer, San Clemente, CA (US)

(73) Assignee: General Electric Company, Schenectady, NY (US)

( * ) Notice: Subject to any disclaimer, the term of this patent is extended or adjusted under 35 U.S.C. 154(b) by 283 days.

(21) Appl. No.: 11/276,559

(22) Filed: Mar. 6, 2006

(65) Prior Publication Data

US 2007/0240648 A1 Oct. 18, 2007

(51) Int. Cl.
*G05B 13/02* (2006.01)
*G05D 3/12* (2006.01)

(52) U.S. Cl. ..... 700/28; 700/286

(58) Field of Classification Search ..... 700/28, 700/29, 30, 31

See application file for complete search history.

(56) References Cited

U.S. PATENT DOCUMENTS 4,864,972 A * 9/1989 Batey et al. ..... 122/448.3
6,381,504 B1 * 4/2002 Havener et al. ..... 700/44
6,678,585 B1 * 1/2004 Havener ..... 700/295
7,058,483 B2 * 6/2006 Havener ..... 700/295
7,151,872 B1 * 12/2006 Xia et al. ..... 385/37
7,194,320 B2 * 3/2007 Lefebvre et al. ..... 700/49
2003/0018399 A1 * 1/2003 Havener et al. ..... 700/28
2003/0109047 A1 * 6/2003 Valentine ..... 436/55
2004/0191914 A1 * 9/2004 Widmer et al. ..... 436/55
2006/0015298 A1 * 1/2006 Daw et al. ..... 702/188

* cited by examiner

*Primary Examiner*—Thomas K Pham
(74) *Attorney, Agent, or Firm*—Sutherland Asbill & Brennan LLP

(57) ABSTRACT

Systems and methods for multi-level optimization of emission levels and efficiency for a boiler system that includes creating both boiler-level models and burner-level models and receiving a plurality of boiler-level system variables. The received system variables are used along with boiler system constraints to optimize boiler-level setpoints. Once the boiler-level setpoints have been optimized they are sent to the burner level of a hierarchical control system, where they are used to optimize burner-level setpoints. Once the burner-level setpoints have been optimized they are sent to the burner control loops of the plant control system to be implemented.

20 Claims, 8 Drawing Sheets

SYSTEMS AND METHODS FOR MULTI-LEVEL OPTIMIZING CONTROL SYSTEMS FOR BOILERS

BACKGROUND OF THE INVENTION

The present disclosure relates generally to process modeling, optimization, and control systems, and more particularly to methods and systems for performing model-based asset optimization, decision-making, and control for fossil-fuel fired boiler systems.

Fossil-fuel fired boiler systems have been utilized for generating electricity. One type of fossil-fuel fired boiler system combusts an air/coal mixture to generate heat energy that increases temperature of water to produce steam. The steam is utilized to drive a turbine generator that outputs electrical power. Carbon monoxide (CO) is a by-product of combusting the air/coal mixture (or any air/hydrocarbon based fuel such as a methane mixture) especially when the air to coal (fuel) ratio, also known as the air to fuel (A/F) ratio, is low. At the same time, due to the spatial variance in combustion, CO levels at particular locations in the boiler system can be greater than a predetermined CO level while other locations have CO levels less than the predetermined CO level. The variance of CO levels in the boiler system can result in increased CO emissions at an exit plane (e.g., output section) of the boiler system and ultimately at the exhaust of the boiler system through the smokestack. At the same time, Nitrogen Oxides (NOx) and other by-products of combustion need to be maintained below a predetermined level. Reducing the variance of CO levels at the exit plane of the boiler also allows for lower levels of excess oxygen ($O_2$), NOx, and CO at the stack, thereby increasing efficiency. Typically, the average CO level at the exit plane of the boiler is highly correlated with the variance in CO at the same plane. Therefore, reducing the average planar CO has a similar intended effect as is achieved by reducing the planar CO variance. As the air to fuel ratio increases, CO decreases while NOx emissions increase. Additionally, as the quantity of intake air increases, the boiler requires more fuel to combust the larger quantity of air because the fans have to drive a larger quantity of air. As a result, the efficiency of the boiler decreases.

Current combustion optimization strategies utilize a zonal control of boilers to reduce variance of CO at the exit plane of the boiler and to allow for individualized control of burner air to fuel (A/F) ratios. Such boiler control solutions use first-principles-based modeling along with data-driven models. Data driven techniques derive relationships or transfer functions from previously gathered systems input-output data. First principles models are based on a mathematical representation of the underlying natural physical principles governing a system's input-output relationships. These models compute and adjust burner level air-flows (Primary Air and Compartment Air) and coal flows to reduce stack CO emissions using transfer functions based partially on the use of Influence Factor (IF) maps. An IF map is illustrative of a Computational Fluid Dynamics (CFD) technology based transfer function representing the effect of individual burner airflows and fuel flows at different locations in the boiler system (e.g., at an exit plane of the boiler). CFD is a first-principle based analysis technique that predicts fluid flow behavior in terms of transfer of heat, mass (such as in perspiration or dissolution), phase change (such as in freezing or boiling), chemical reaction (such as combustion), mechanical movement (such as an impeller turning), and stress or deformation of related solid structures (such as a mast bending in the wind). The information provided by the IF maps assist in controlling and minimizing the spatial average and variance of CO at the exit plane of a boiler by adjusting a particular burner's A/F ratio in such a way that provides an expected effect on a CO sensor reading located at the exit plane in the boiler system. Such a solution is presented in U.S. patent application Ser. No. 11/290,754 entitled "System, Method, And Article Of Manufacture For Adjusting CO Emission Levels At Predetermined Locations In A Boiler System," which is incorporated by reference in its entirety as if set forth fully herein.

This method requires the creation of multiple CFD-IF maps corresponding to each unique plant operational condition. For example, a CFD-IF map corresponding to when all mills or compartments supplying coal to their respective group of burners are operational may not represent accurately a situation when one of the mills (in other words a group of burners getting coal supply from single pulverizer) may be turned off and is not operational. As a result, these CO grid mean-variance optimization algorithms have to rely on multiple IF maps for different operating conditions of a given boiler system. While such multiple CFD-IF maps can be generated, a drawback is the effort required for the generation and fine-tuning of the individual elements of each map to suit a specific boiler condition since the dimensionality of these maps is quite a challenge for standard adaptation techniques such as Kalman filter. Consequently, it has been suggested that it might be easier to fit a hyper-plane through a generic IF map and then adapt the slope and curvature of such a hyper-plane to reduce the dimensionality for adaptation. An alternative is to adapt a weighted average of multiple IF maps representing different boiler conditions such as baseload, partload, mills out of service, etc. However, simplifying the adaptation technique often results in the reduced accuracy of the adapted map in representing the condition that it's being adapted for, and hence adversely affects the optimization accuracy as well. Another drawback of the current CO grid mean-variance optimization strategy is that it does not explicitly consider higher-level boiler performance criteria such as the amount of NOx produced and the Heat Rate at a plant-level. NOx production and Heat Rate are typically mutually competing goals, i.e., a lower NOx level usually leads to a higher Heat Rate (which is coupled to lower efficiency), and vice-versa.

What is needed is an approach that addresses the above-mentioned drawbacks, thereby achieving an optimization of coal-fired boilers at both the boiler/mill level and at the burner level addressing both higher level objectives such as NOx emissions and heat rate and lower level objectives such as spatial CO variance along with stack CO reduction.

SUMMARY OF THE INVENTION

According to an embodiment of the invention, there is disclosed a method for multi-level optimization of emission levels for a boiler system. The method includes creating boiler-level models and burner-level models; receiving a plurality of boiler-level system variables and optimizing boiler-level setpoints, based at least in part on the received boiler-level system variables. The method further includes deploying the optimized boiler-level setpoints to a plant control system of the boiler system. The method further includes optimizing burner-level setpoints, based at least in part on the received boiler-level setpoints; and deploying the optimized burner-level setpoints to one or more burner control loops of the plant control system.

According to one aspect of the invention the creation of boiler-level and burner level models includes validating the boiler-level and burner-level models. According to another aspect of the invention the boiler system variables include one or more boiler system constraints and stack-level constraints. According to yet another aspect of the invention the method further includes adjusting the burner level variables of the plant control system based at least in part on the optimized burner level setpoints.

According to another aspect of the invention the method further includes adjusting the boiler level variables of the plant control system based at least in part on the optimized boiler level setpoints. According to yet another aspect of the invention the optimization of the boiler-level setpoints includes processing the received boiler-level variables with one or more boiler level objective functions and then optimizing the results through a multi-objective optimizer. According to yet another aspect of the invention the method includes recording boiler-level setpoints and boiler level predictive performance data of the boiler level objective functions and the multi-objective optimizer. According to another aspect of the invention the method includes determining if the predictive models satisfy predetermined threshold values for the boiler-level system variables.

According to another aspect of the invention the optimization of the burner level setpoints includes processing the received burner level variables with one or more burner level objective functions and then optimizing the results through an optimizer. According to yet another aspect of the invention the method includes recording burner level setpoints and burner level predictive performance data of the burner level objective functions and the optimizer. According to yet another aspect of the invention the method includes determining if the predictive models satisfy predetermined threshold values for the burner-level system variables.

According to another embodiment of the invention, there is disclosed an hierarchical optimization system for controlling the inputs of a boiler system that includes a higher level component, where the higher level component includes a boiler-level optimizer and a plurality of boiler-level predictive models adaptable to predict boiler output parameters of a boiler system based on training data. The boiler-level optimizer queries the predictive models to identify a plurality of boiler level setpoints. The system also includes a lower level component in communication with the higher level component, where the lower level component includes a burner-level optimizer and one or more burner level predictive models adaptable, based on the boiler level setpoints, to predict a plurality of burner settings. The burner level optimizer queries the predictive models to identify one or more burner level settings. Moreover, both the higher level component and the lower level component are in communication with an existing plant control system of the boiler system.

According to one aspect of the invention at least one predictive model is a combination of a data based neural network and a first-principle based CFD model. According to another aspect of the invention the training data includes one or more historical boiler parameters each associated with one or more emission readings. According to yet another aspect of the invention the system includes at least one accessible database for storing the burner level predictive models. According to yet another aspect of the invention the higher level component and the lower level component are in communication over a network. According to yet another aspect of the invention both the higher level component and the lower level component are accessible through a user interface.

According to another embodiment of the invention, there is disclosed method for adjusting emission levels within a boiler system. The method includes receiving one or more signals from one or more sensors disposed at one or more locations in a boiler system, where each of sensors is associated with at least one burner. The method further includes receiving one or more boiler parameters and one or more burner parameters from the sensors and updating a model of the boiler system based on at least one of the signals received. The method further includes the determination of an air flow setting and a fuel flow setting based in part on a predictive model for one or more of the burners. The method also includes setting an air flow setting and a fuel flow setting for at least one burner to optimize the emission levels at the locations, based on the determination of the predictive model.

According to one aspect of the invention the step of receiving one or more signals from one or more sensors disposed at one or more locations in a boiler system includes receiving signals from carbon monoxide (CO) sensors, loss of ignition (LOI) sensors, and temperature sensors. According to another aspect of the invention the step of determining an air flow setting and a fuel flow includes using a predictive model that may be a data driven neural network model, a first principle based Computational Fluid Dynamics (CFD) model, or a hybrid of both.

DESCRIPTION OF THE DRAWINGS

Figure 1:
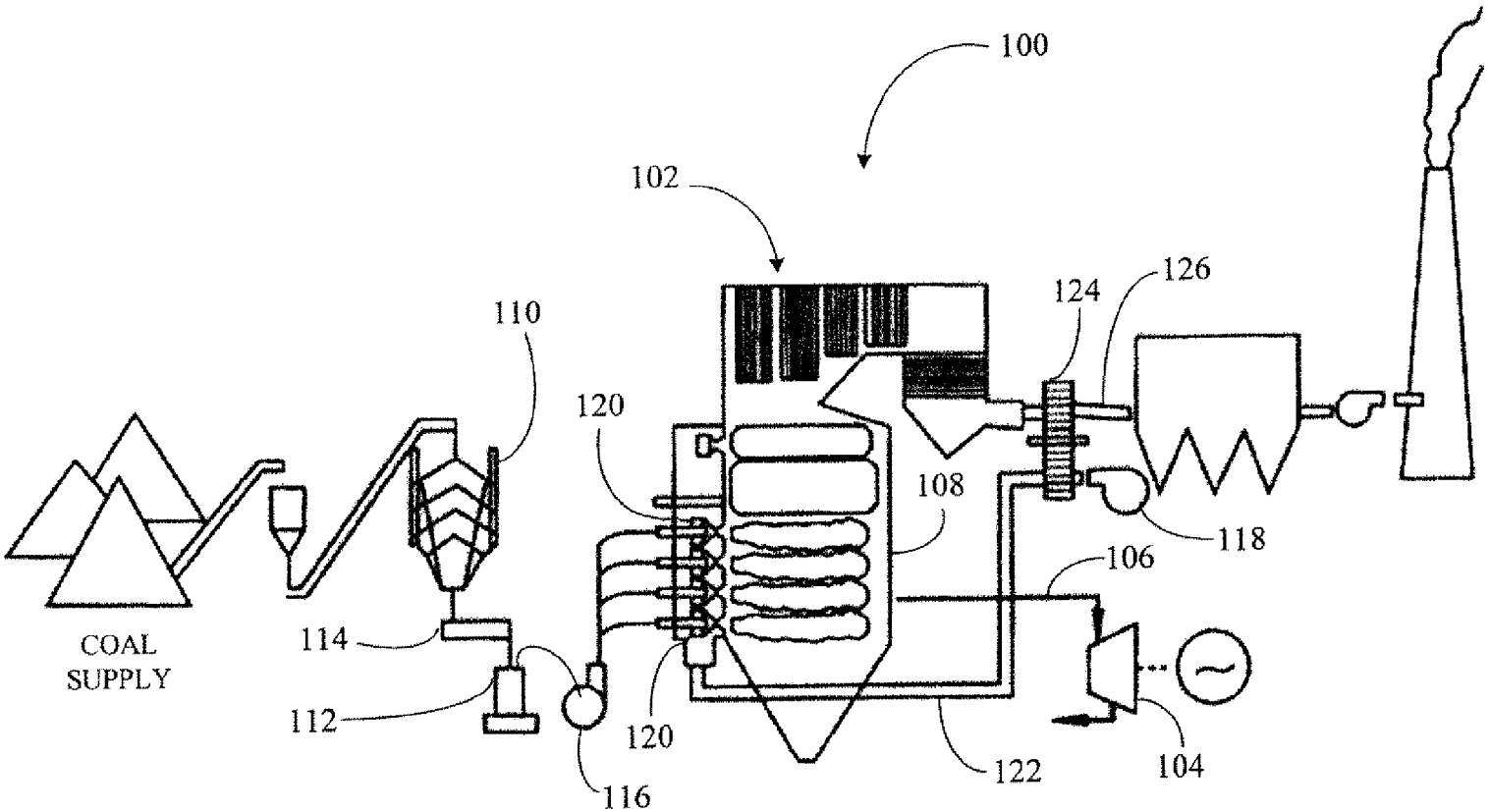

Having thus described the invention in general terms, reference will now be made to the accompanying drawings, which are not necessarily drawn to scale, and wherein:

FIG. 1 is a block diagram of a fossil-fuel fired boiler system in accordance with an exemplary embodiment of the present invention.

Figure 2:
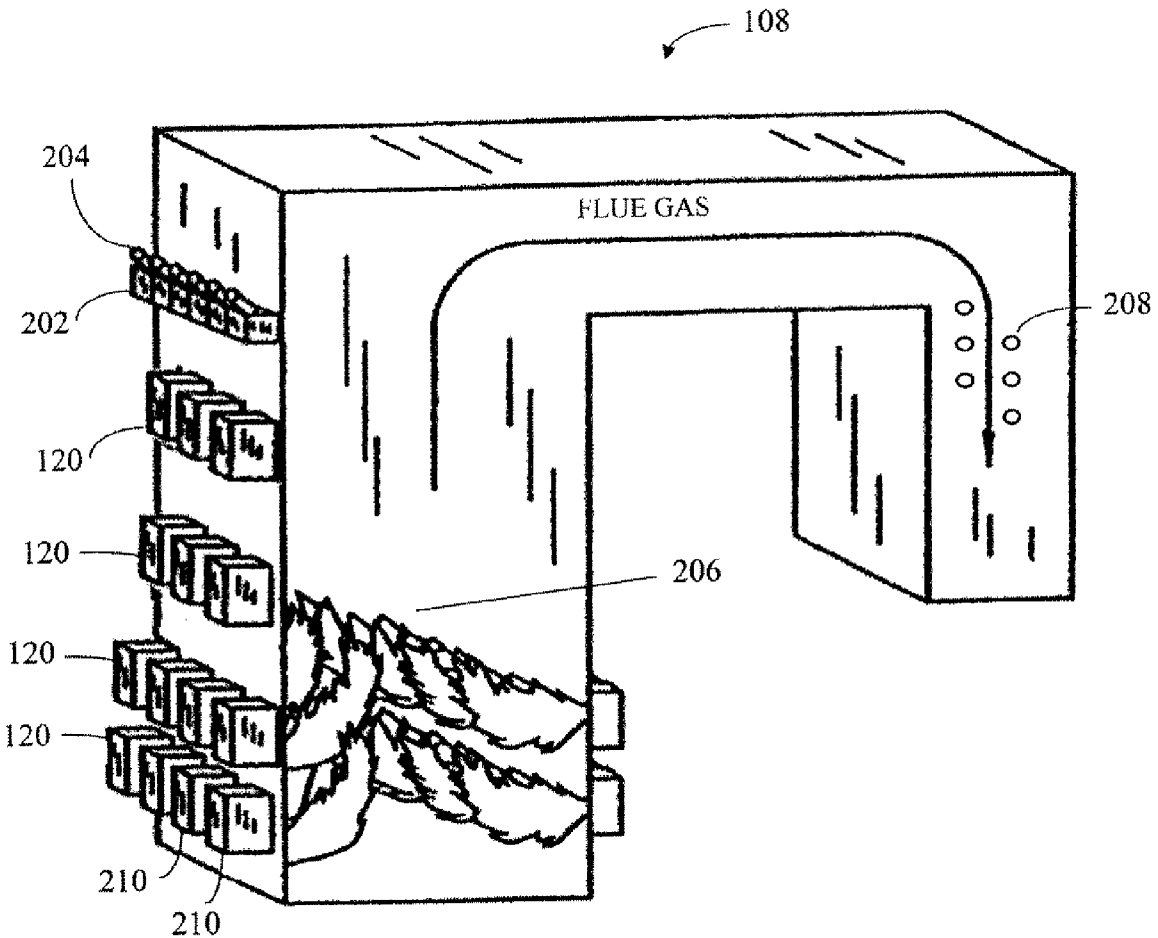

FIG. 2 is a schematic diagram of a boiler in accordance with the exemplary embodiment of the invention.

Figure 3:
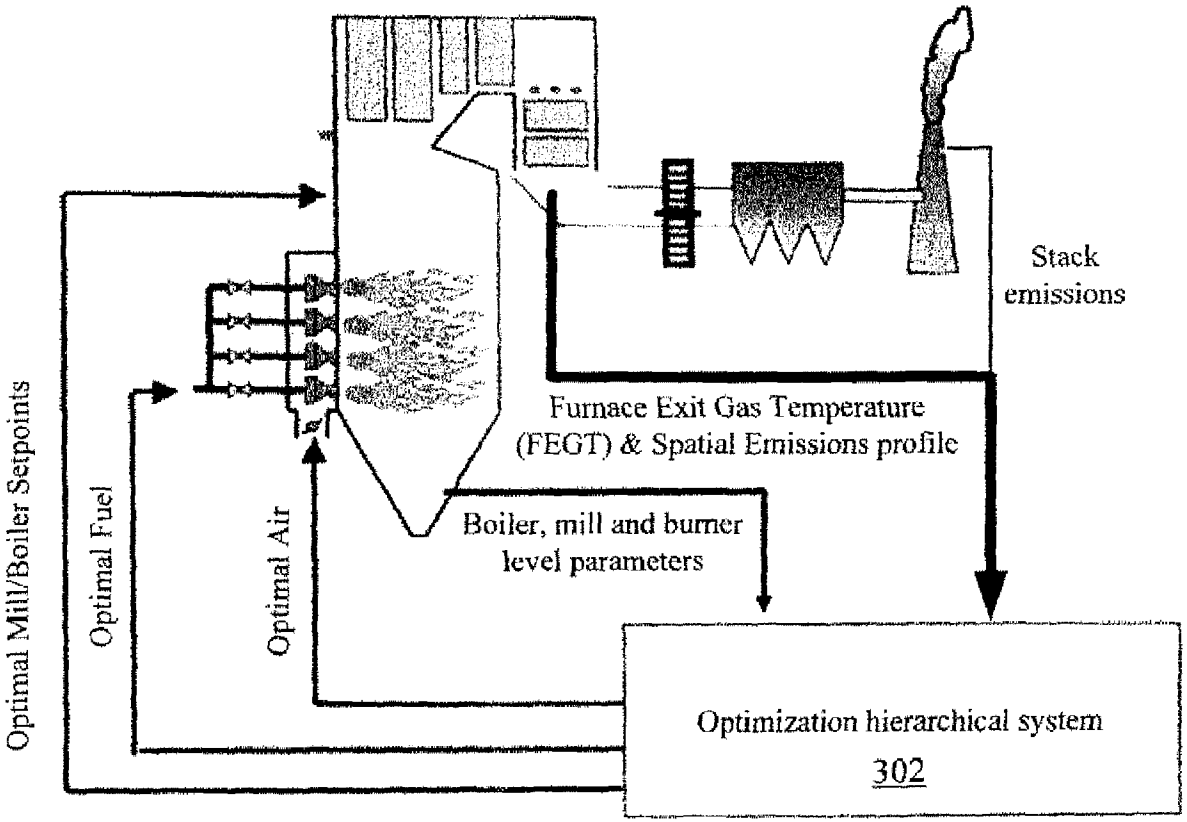

FIG. 3 shows the connection of the boiler system to the optimization control system in accordance with the exemplary embodiment of the invention.

Figure 4:
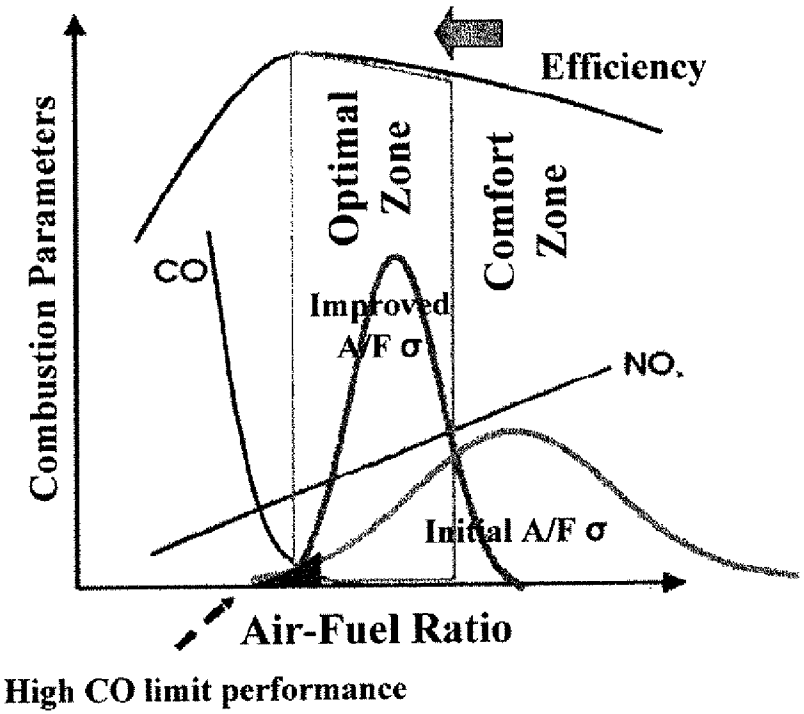

FIG. 4 is a graph of combustion parameters versus air to fuel (A/F) ratio in accordance with an exemplary embodiment of the present invention.

Figure 5:
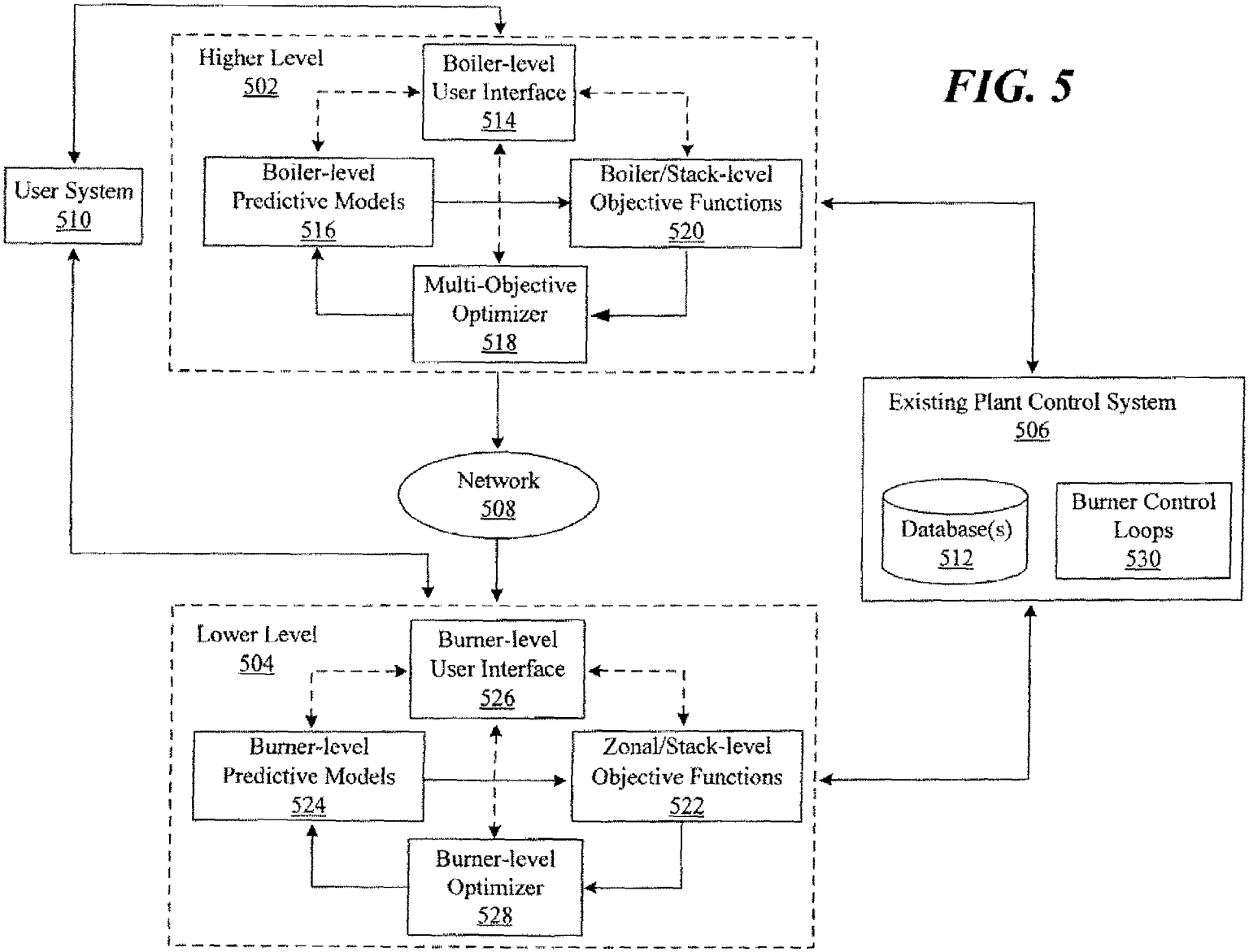

FIG. 5 is a block diagram of the multi-level boiler optimization system in accordance with an exemplary embodiment of the present invention.

Figure 6:
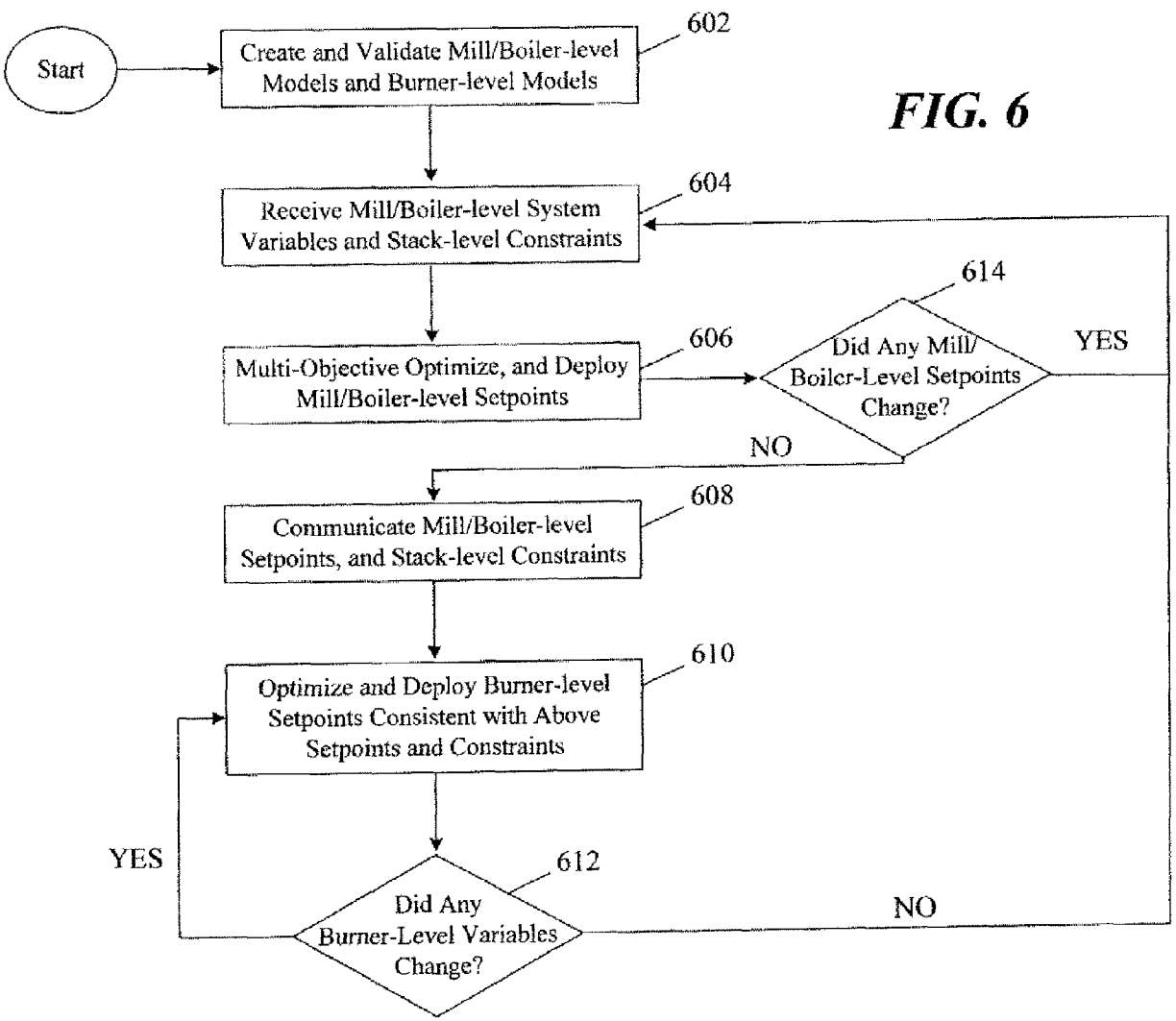

FIG. 6 is a flowchart of the overall multi-level optimization process of controlling various emission levels in accordance with an exemplary embodiment of the present invention.

Figure 7:
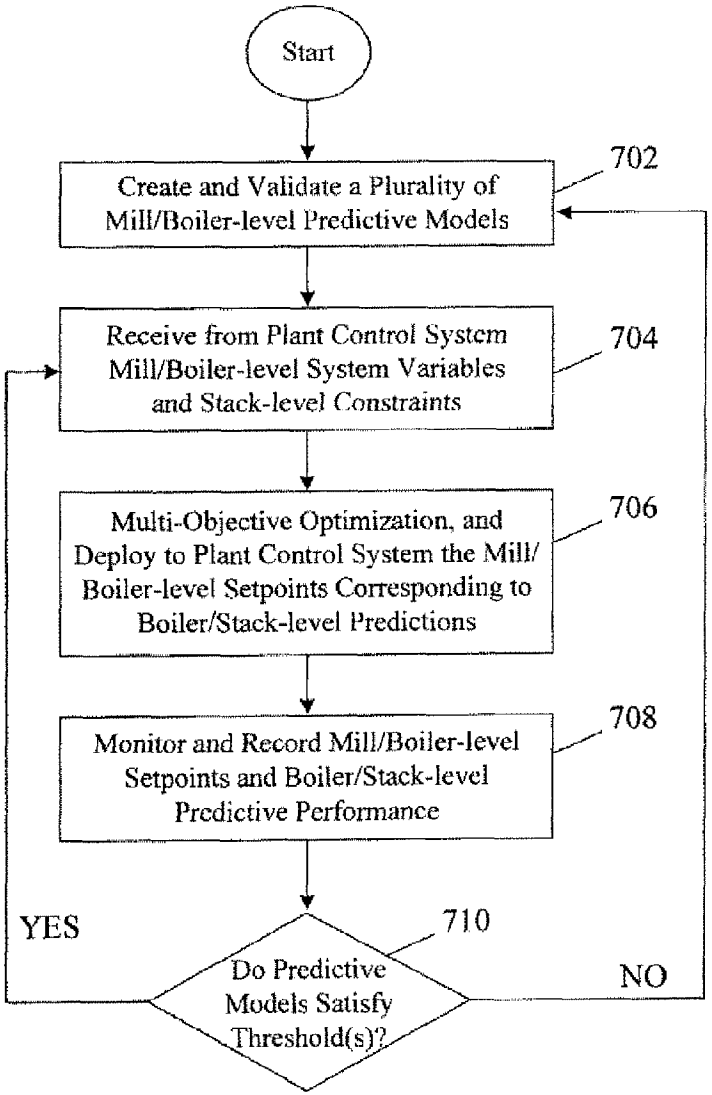

FIG. 7 is a flowchart that describes the higher-level model-based optimization process in accordance with an exemplary embodiment of the present invention.

Figure 8:
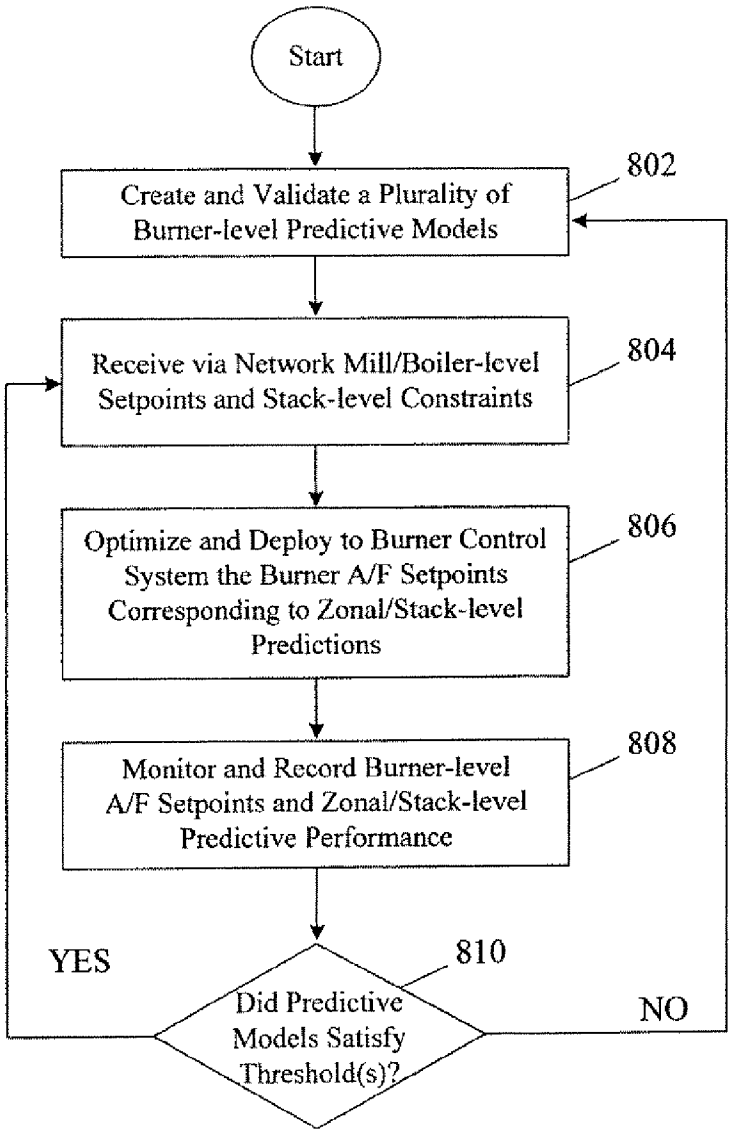

FIG. 8 is a flowchart that describes the lower-level model-based optimization process in accordance with an exemplary embodiment of the present invention.

DETAILED DESCRIPTION OF THE INVENTION

The present invention is directed to the integration of higher-level (e.g., boiler/mill level) model-based multi-objective optimization and lower level (e.g., burner level) model-based optimization of coal fired utility boiler control.

The predictive models in these two hierarchal levels may be based on data-driven techniques, first principles-based techniques, or a combination of the two techniques (e.g., hybrid modeling). The hybrid modeling technique may incorporate first-principle based models into a data driven model (or a pure data driven model can be designed) so that the dependency on a variety of Computational Fluid Dynamics (CFD) based models does not become a modeling bottleneck. The optimizers in both the higher level and lower level sections of the hierarchal optimization system may be based on stochastic global optimization techniques (e.g., Genetic/Evolutionary Algorithms), gradient-based optimization techniques, or a combination of the two techniques.

In exemplary embodiments of the present invention, first-principles-based methods may be used in conjunction with the data-driven models for constructing predictive models representing a system's input-output relationships. Moreover, in exemplary embodiments of the present invention the combination of modeling and optimization in the coal fired utility boiler control system is modular, which allows for flexibility in the architecture of the targeted implementation platform. This form of hybrid multi-level modeling and optimization utilizes a hierarchical control architecture containing a "higher-level" module (or "mill/boiler-level" module) and a "lower-level" module (or "bumer-level" module). The optimized decisions made in the higher level may be communicated to the lower level to be used as targets or constraints in the lower-level optimization.

Moreover, the optimizations at the higher and lower levels may operate at dissimilar frequencies, typically with the higher-level making optimized decisions at a lower frequency than the lower-level optimization. The optimization system at the top-level of the control hierarchy determines the parameters to send to the lower-level where the lower-level utilizes those parameters to adjust the inputs to the boiler system to achieve the optimized parameter values passed down from the top-level optimization system. Such layering of optimization techniques may reduce NOx emissions and improve heat rate by reducing excess air or $O_2$ while addressing stack CO constraints.

While the invention is described with respect to boiler systems found in a coal-fired plant, it will be understood that the optimization hierarchal system is equally adaptable for use in a variety of other industries and for a wide variety of systems (e.g., gas turbines, oil-fired boilers, refinery boilers, aircraft engines, marine engines, gasoline engines, diesel engines, hybrid engines, etc.). The coal-fired boiler embodiment described herein is provided for illustration and is not to be construed as limiting in scope. An advantage of the present invention is that it is a mathematically simpler and computationally feasible technique to adapt the multi-dimensional IF map and not lose the accuracy in the process due to approximation in the first place for adaptation.

The present invention will be described below with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is described below with reference to block diagrams of systems, methods, apparatuses and computer program products according to an embodiment of the invention. It will be understood that each block of the block diagrams, and combinations of blocks in the block diagrams, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functionality of each block of the block diagrams, or combinations of blocks in the block diagrams discussed in detail in the descriptions below.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

Accordingly, blocks of the block diagrams support combinations of means for performing the specified functions, combinations of steps for performing the specified functions and program instruction means for performing the specified functions. It will also be understood that each block of the block diagrams, and combinations of blocks in the block diagrams, can be implemented by special purpose hardware-based computer systems that perform the specified functions or steps, or combinations of special purpose hardware and computer instructions.

The inventions may be implemented through an application program running on an operating system of a computer. The inventions also may be practiced with other computer system configurations, including hand-held devices, multiprocessor systems, microprocessor based or programmable consumer electronics, mini-computers, mainframe computers, etc.

Application programs that are components of the invention may include routines, programs, components, data structures, etc. that implement certain abstract data types, perform certain tasks or actions. In a distributed computing environment, the application program (in whole or in part) may be located in local memory, or in other storage. In addition, or in the alternative, the application program (in whole or in part) may be located in remote memory or in storage to allow for the practice of the inventions where tasks are performed by remote processing devices linked through a communications network. Exemplary embodiments of the present invention will hereinafter be described with reference to the figures, in which like numerals indicate like elements throughout the several drawings.

FIG. 1 is a schematic view of a coal-fired power generating system in accordance with an exemplary embodiment of the present invention. In the exemplary embodiment shown in FIG. 1, the power generating system includes a boiler 102 coupled to a steam turbine-generator 104. Steam is produced in boiler 102 and flows through a steam pipe 106 to the steam turbine-generator 104. Boiler 102 burns fossil fuel, (e.g., coal) in a boiler furnace 108, which produces heat to convert water into steam used to drive the steam turbine-generator 104. In alternative embodiments, the fossil fuel burned in the boiler 102 may include oil or natural gas or other fuels appreciable by one of ordinary skill in the art. If the boiler is using coal as its fuel, crushed coal is stored in a silo 110 and is further ground or pulverized into fine particulates by a pulverizer 112. A coal feeder 114 adjusts the flow of coal from the coal silo 110 into the pulverizer 112 that supplies coal to a group of burners (mill or compartment). An air source 116 (e.g., fan) is used to convey the coal particles from the pulverizer 112 to burners 120, the air source 116 is referred to as primary air. A second air source 118 (e.g., fan) supplies secondary air to burners 120 through an air conduit 122. The secondary air is heated by passing through a regenerative heat exchanger 124 located in a boiler exhaust line 126.

FIG. 2 is a schematic diagram of a boiler in accordance with the exemplary embodiment of the invention. As shown in FIG. 2, the boiler furnace 108 may include one or more loss of ignition (LOI) sensors 202 and one or more temperature sensors 204 in a grid formation located upstream from a flame envelope 206 formed by burning coal at burners 120. A grid of one or more CO sensors 208 are located in an exit portion of the boiler furnace 108. The location of LOI sensors 202, temperature sensors 204, and CO sensors 208 in each grid correspond to burners 120, which are also in a grid arrangement. In other words, an LOI sensor 202, a temperature sensor 204, and a CO sensor 208 is located in alignment of each column 210 of burners 120. Additional sensors, such as additional CO sensors 208, may be located at a smokestack. At the same time, LOI sensors 202 grid, temperature sensors 204 grid, and CO sensors 208 grid may be located together at locations within the boiler system such as all three grids near the superheat zone, or in the reheat zone or at the exit plane (output) of the boiler so that each location in the grid will have three sensors (e.g., LOI, temperature and CO). In alternative embodiments of the invention, other types of sensors monitor the combustion process occurring in boiler furnace 108, for example, O2 sensors, CO2 sensors, NOx sensors, and optical radiation sensors including variable component of radiation sensors may also be used.

FIG. 3 shows the connection of the boiler system to the multi-level optimization control system in accordance with the exemplary embodiment of the invention. As shown in FIG. 2, the information read from the sensors located in the boiler and/or mill and stack system is fed back to the optimization hierarchical system 302 along with other boiler/mill level parameters such as airflows, coal flows, temperatures, pressures, etc. The optimization hierarchical system 302 utilizes these readings to assist in determining the setpoints for the boiler and burners (air and fuel flow settings) to achieve optimal boiler performance (e.g., with respect to the various performance criteria of interest). The optimization hierarchical system 302 uses predictive models (e.g., data driven models such as Neural Networks or first principles based models such as CFD) to map boiler inputs to outputs that need to be optimized such as NOx, Heat Rate, CO sensor grid mean value and variance, utilizing a combination of optimization algorithms.

FIG. 4 shows a graph of combustion parameters versus air to fuel (A/F) ratio for a burner in accordance with an exemplary embodiment of the present invention. As shown in FIG. 4, the burner A/F spread or variance ($\sigma$) can be improved by the multi-level optimization control system. Specifically, the higher level of the hierarchical control system is intended to move the burner AF spread from the comfort zone (non-optimal) to the optimal zone thereby reducing NOx and improving efficiency. The lower level optimization of the control system narrows (or "squeezes") down the burner A/F spread in the optimal zone reducing spatial CO variance and stack CO levels subject to the constraints set by the higher level optimization of the hierarchical control system. The optimization hierarchical control system and its process by which it optimizes the boiler system will be discussed with reference to FIGS. 5-8 below.

FIG. 5 shows the multi-level hierarchical optimization system 302 in accordance with an exemplary embodiment of the invention. At the higher-level 502 of the control hierarchy is a multi-objective optimization system aimed at globally optimizing a power plant/boiler for specified objectives, without being concerned with the detailed objectives of the lower-level burner A/F optimization 504. In the exemplary embodiment of FIG. 5, the higher-level 502 and lower-level 504 of the control hierarchy shown in FIG. 5 are in communication with a user system 510 and an existing plant control system 506. Also shown in the exemplary embodiment of FIG. 5 is that the higher-level 502 may communicate with the lower level 504 via a network 508. The network 508 may be any type of known network including, but not limited to, one or a combination of a wide area network (WAN), a local area network (LAN), a global network (e.g. Internet), a virtual private network (VPN), and/or an intranet. The network 508 may be implemented using a wireless network or any kind of physical network implementation known in the art. In alternative embodiments of the invention, the higher level system 502 and lower level system 504 may be integrated as sections one large control system running on the same server.

The higher level system 502 may include a graphical user interface 514, boiler-level predictive models 516, a multi-objective optimizer 518, and boiler/stack-level objective functions 520. The boiler-level user interface 514 provides access to the components of the higher level system 502 of the hierarchal optimization system to a user either directly or through the user system 510. The boiler-level predictive models 516 may be based on Neural Networks or could be combination of Neural Networks and first-principles based CFD models that are used to model boiler system behavior in terms of stack emissions such as NOx or CO and in terms of performance parameters such as efficiency which is a function of excess air, fan power input, fuel quality and overall combustion efficiency. Essentially, these predictive models need to be adapted to match the boiler system performance. For example, the neural network based predictive models need to be presented with appropriate training data, which represents the boiler behavior. Upon learning the training set, the model should be able to predict the boiler behavior with required accuracy so that these predictions can then by used by the multi-objective optimizer 518 to optimize boiler level objective functions 520 such as reducing stack emissions and improving efficiency.

In the exemplary embodiment shown in FIG. 5, given a set of ambient conditions for the boiler, a multi-objective optimizer 518 utilizes the boiler-level predictive models 516 of the boiler control system to identify the Pareto-optimal set of input-output vector tuples that satisfy the system's operational constraints. For example, the inputs are boiler and/or mill level airflows, coal flows, and the outputs are parameters to be optimized such as NOx emissions and efficiency. These optimization parameters define the objective functions including the functions of emission reduction and efficiency improvement that are being addressed by the multi-objective optimizer 518. The multi-objective optimizer 518 may utilize a set of historically similar operating points as seed points (or "setpoints") to initiate a flexible restricted search of the given search space around these points. A domain-based objective/fitness function 520 is superimposed on the Pareto-optimal set of input-output vector tuples to filter and identify an optimal input-output vector tuple for the set of ambient conditions. Therefore, at a set time, the multi-objective optimizer 518 queries (or probes) the predictive models 516 to identify a set of feasible Pareto-optimal operating points using the objective functions 520. A Pareto-optimal decision from this set is communicated to the existing plant control system 506 and is transmitted to the lower level 504 via the network 508. For example, this decision implies optimal boiler/mill level airflows that meet the optimization objective of reducing emissions and improving heat rate or efficiency. This method is described in U.S. patent application Ser. No. 11/116,920 entitled "Method And System For Performing Model-Based Multi-Objective Asset Optimization And Decision-Making" and in U.S. patent application Ser. No. 11/117,596 entitled "Method And System For Performing Multi-Objective Predictive Modeling, Monitoring, And Update For An Asset," which are both incorporated by reference in their entirety as if set forth fully herein.

The lower-level system 504 utilization of NN-based modeling and burner optimization algorithms may reduce CO variance and stack CO. The lower level system 504 includes a graphical user interface 526, burner-level predictive models 524, a burner-level optimizer 528, and zonal/stack-level objective functions 522. The burner level user interface 526 provides access to the components of the lower level system 504 of the hierarchal optimization system to a user either directly or through the user system 510. The burner level predictive models 524 could be first principles based or data driven. These burner level predictive models 524 use the boiler level optimized setpoints from the higher level to predict a plurality of burner settings. In the exemplary embodiment of the present invention, CFD analysis applied to boiler combustion may be used for the predictive models 524. A first-principles CFD-based predictive model 524 of the boiler combustion may be created and used to calculate the influence the combustion at each burner has on the CO production at the exit plane of the boiler. The modeling is performed in two stages. In the first stage, the CFD based IF map translates the various burner A/F ratios to a set of virtual sensor A/F ratios. A data-driven Recursive Least Squares (RLS) algorithm is then employed to translate the sensor A/F ratios to sensor CO values at the exit plane of the boiler. The RLS-based transfer function portion is created using historical operational data wherein burner A/F ratios and other combustion parameters of relevance are available along with a corresponding set of CO readings from the CO sensors at the exit plane of the boiler and at the stack. This feed-forward model from burner A/Fs to sensor CO is then subjected to optimization using gradient descent techniques to get optimal burner A/Fs that would reduce CO variance or mean at the exit plane of the boiler and effectively reduce stack CO emissions. This burner level optimizer 528 can be used to optimize parameters other than emissions such furnace exit gas temperatures, slagging and fouling in the boiler zones, etc. This method is presented in U.S. patent application Ser. No. 11/290,754 entitled, "System, Method, And Article Of Manufacture For Adjusting CO Emission Levels At Predetermined Locations In A Boiler System," which is incorporated by reference in its entirety as if set forth fully herein.

At a set time, the burner-level optimizer 528 queries (or probes) the burner level predictive models 524 to identify a set of feasible burner A/F settings using the objective functions 522 for reducing the appropriate metric of emissions such as mean or variance at the exit plane (output) of the boiler and at the stack. These feasible burner settings follow the setpoint constraints imposed by the Pareto-optimal decision communicated to the existing plant control system 506 and through the network 508. A decision from this lower level is communicated to the burner control loops 530 of the existing plant control system 506. As mentioned earlier, the burner level predictive models 524 may be based on CFD, Neural Networks or hybrid models combining the two techniques. The higher level 502 and lower level 504 of the control hierarchy may be implemented via computer instructions (e.g., one or more software applications) executing on a server, or alternatively, on a computer device, such as the user system 510 itself. If executing on a server, then the user system 510 may access the features of the higher-level system 502 or lower level system 504 over network 508.

Also shown in the exemplary embodiment of FIG. 5 is a database 512 that may be implemented using memory contained in the existing plant control system 506, or within the user system 510 or another location. In an exemplary embodiment, the database 512 is logically addressable as a consolidated data source across a distributed environment that includes the network 508. Information stored in the database 512 may be retrieved and manipulated via the higher level system 502 and may be viewed via the user system 510. In exemplary embodiments of the invention, the boiler's historical data, which refers to measurable input-output elements (e.g., historical boiler parameters each associated with corresponding emission readings) resulting from operation of the boiler may be stored in the database 512. Such stored historical data may include the measurable elements such as emission levels of, e.g., NOx, carbon monoxide, and sulfur dioxides. The stored data may also include operating conditions of the boiler, such as fuel consumption and efficiency. Ambient conditions, such as air temperature and fuel quality may be also be measured, recorded and included with the historical data. Nonlinear predictive, data-driven models may be trained and validated on the boiler's historical data stored in the database 512 to more accurately represent the boiler's input-output behavior. The models to be trained and validated may also be stored in the database 512 or, alternatively, in another accessible storage location (e.g., predictive models 516).

As shown in the exemplary embodiment of FIG. 5, the user system 510 may be implemented using a general-purpose computer executing one or more computer programs for carrying out the processes described herein. The user system 510 may be a personal computer (e.g., a laptop, a personal digital assistant) or a host attached terminal. If the user system 510 is a personal computer, the processing described herein may be shared by the user system 510 and the host system server (e.g., by providing an applet to the user system 510). The user system 510 and/or user interfaces 514, 526 allows for a user to access for updating, utilizing, or troubleshooting the various system elements of the top level 502 and lower level 504 optimization and control systems such as the predictive models 516, 524, the objective functions 520, 522, and the optimizers 518, 528. The user interfaces may also interact with the existing plant control system 506.

An exemplary process of adjusting the inputs of the boiler system conducted by the hierarchal optimization system of FIG. 5 is described in further detail in FIG. 6 below. This multi-level optimization process may be repeated as a function of time or as a function of changing operating and ambient conditions in the system (i.e., boiler system). Various methods of implementing the prediction and optimization functions may be employed as described further herein.

FIG. 6 is a flowchart of the overall multi-level optimization process of controlling/optimizing various parameters such as efficiency and emission levels in accordance with an exemplary embodiment of the present invention. The process begins at step 602 where the higher level (e.g., mill/boiler-level) models and the lower level (e.g., burner level) models are created and validated. Next, step 604 is invoked where the mill/boiler level system variables and boiler system constraints including stack-level constraints are received by the boiler/stack level models and objective functions of the higher level of the optimization system. Once the steps 602 and 604 have been performed, step 606 involves implementing the higher level multi-objective optimizer to utilize the received boiler-level system variables and boiler system constraints to optimize boiler and mill level setpoints, and then deploys optimized boiler and mill level setpoints to the existing plant control system. Step 614 is then invoked to determine if any of the mill/boiler-level operating parameters or setpoints changed from a previous set value (e.g., ambient air temperature change, coal-quality value change, mill out-of-service detection, etc.). If so, the process returns to step 604 for further optimization. In an exemplary embodiment of the invention, the higher-level optimization system operates at a different frequency than the lower-level. As a result the lower-level variable values may update several times for every one time the higher-level variables update. The mill/boiler level variables are likely to change at a lower frequency avoiding the control system from entering an endless loop. If the mill/boiler-level setpoints did not change over some predefined number of iterations, then the optimization is complete and step 608 is invoked to communicate the mill-boiler-level setpoints and stack level constraints over a network to the lower level (e.g., burner level) of the optimization system.

At the lower level, step 610 is invoked to optimize and deploy burner-level setpoints consistent with the mill-boiler-level setpoints received from the higher level of the optimization system. The burner-level setpoints are determined through the use of the burner-level predictive models, zonal/stack-level objective functions, and/or burner-level optimizer utilizing the mill/boiler-level setpoints and stack-level constraints received from the higher level of the optimization system. Once determined, the burner-level setpoints are sent to the existing plant control system's burner control loops to utilize the burner-level setpoints to adjust the burner level variables. Next, step 612 determines if any of the burner level variables changed as a result of the deployment of the burner level setpoints (e.g., if any burner's currently out of service, etc.). If the burner level setpoints did change, then step 610 is repeated to continue optimizing the burner-level variables. Once the burner-level variables are no longer changing over some predefined number of iterations, the process returns to step 604, where the higher level of the optimization system begins re-optimizing the mill-boiler level setpoints.

FIG. 7 is a flowchart that describes the higher-level model-based optimization process in accordance with an exemplary embodiment of the present invention. The higher-level optimization process begins at step 702 where one or more mill/boiler-level predictive models are created and validated. Next, step 704 is invoked, where the higher level of the hierarchal optimization system receives (or retrieves) mill/boiler-level variables and stack-level constraints from the existing plant control system. Step 706 then begins multi-objective optimization by processing the mill/boiler-level variables and stack-level constraints with the boiler/stack level models and objective functions and then optimizing the results through the multi-objective optimizer.

Once optimized, the mill/boiler-level setpoints corresponding to the boiler/stack-level predictions from the boiler-level predictive models are deployed to the existing plant control system and/or the lower-level of the hierarchal optimization control system. Next, step 708 is invoked to monitor and record mill/boiler-level setpoints and boiler/stack-level predictive performance of the boiler/stack-level objective functions and the multi-objective optimizer. Step 710 then determines if the predictive models satisfy predetermined threshold (e.g., quality of prediction) values for the mill/boiler-level system variables. If so, then step 704 is invoked and the optimization procedure is repeated. If the predictive models do not satisfy predetermined thresholds, then step 702 is re-invoked to create and validate new mill/boiler-level predictive models.

FIG. 8 is a flowchart that describes the lower-level model-based optimization process in accordance with an exemplary embodiment of the present invention. The lower-level optimization process begins at step 802 where one or more burner-level predictive models are created and validated. Next, step 804 is invoked, where the lower level of the hierarchal optimization system receives mill/boiler-level setpoints and stack-level constraints from the higher level of the hierarchal optimization control system via a network. Step 806 then begins optimizing burner A/F setpoints corresponding to zonal/stack level predictions by processing the mill/boiler-level variables and stack-level constraints received from the higher level of the hierarchal optimization system with the zonal/stack level objective functions and then optimizing the results through the burner-level optimizer.

Once optimized, the burner A/F setpoints corresponding to the zonal/stack-level predictions from the burner-level predictive models are deployed to the burner control loops of the existing plant control system. Next, step 808 is invoked to monitor and record burner-level A/F setpoints and zonal/stack-level predictive performance of the zonal/stack-level objective functions and the burner-level optimizer. Step 810 then determines if the predictive models satisfy predetermined threshold (e.g., quality of prediction) values for the burner-level system variables. If so, then step 804 is invoked and the optimization procedure is repeated. If the predictive models do not satisfy predetermined thresholds, then step 802 is re-invoked to create and validate new burner-level predictive models.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of multi-level optimization of emission levels and efficiency for a boiler system, comprising:

creating boiler-level models and burner-level models;

receiving a plurality of boiler-level system variables;

optimizing boiler-level setpoints, based at least in part on the received boiler-level system variables;

thereafter deploying the optimized boiler-level setpoints to a plant control system of the boiler system;

optimizing burner-level setpoints, based at least in part on the received boiler-level setpoints; and thereafter deploying the optimized burner-level setpoints to at least one burner control loop of the plant control system.

2. The method of claim 1, wherein creating boiler-level and burner level models includes validating the boiler-level and burner-level models.

3. The method of claim 1, wherein the boiler system variables include a plurality of boiler system constraints and stack-level constraints.

4. The method of claim 1, further comprising adjusting the burner level variables of the plant control system based at least in part on the optimized burner level setpoints.

5. The method of claim 1, further comprising adjusting the boiler level variables of the plant control system based at least in part on the optimized boiler level setpoints.

6. The method of claim 1, wherein optimizing boiler-level setpoints further includes processing the received boiler-level variables with a plurality of boiler level models and objective functions; and then optimizing the results through a multi-objective optimizer.

7. The method of claim 6, further comprising recording boiler-level setpoints and boiler level predictive performance data of the boiler level models and objective functions and the multi-objective optimizer.

8. The method of claim 1, further comprising determining if the predictive models satisfy predetermined threshold values for the boiler-level system variables.

9. The method of claim 1, wherein optimizing burner level setpoints further includes processing the received burner level variables with a plurality of burner level models and objective functions; and then optimizing the results through an optimizer.

10. The method of claim 9, further comprising recording burner level setpoints and burner level predictive performance data of the burner level models and objective functions and the optimizer.

11. The method of claim 10, further comprising determining if the predictive models satisfy predetermined threshold values for the burner-level system variables.

12. An hierarchical optimization system for controlling the inputs of a boiler system, comprising:

a higher level component, wherein the higher level component includes a boiler-level optimizer and a plurality of boiler-level predictive models adaptable to predict boiler output parameters of a boiler system based on training data and, wherein the boiler-level optimizer queries the predictive models to identify a plurality of boiler level setpoints; and a lower level component in communication with the higher level component wherein the lower level component includes a burner-level optimizer and a plurality of burner level predictive models adaptable, based on the boiler level setpoints, to predict a plurality of burner settings, wherein the burner level optimizer queries the predictive models to identify the plurality of burner level settings, and wherein both the higher level component and the lower level component are in communication with an existing plant control system of the boiler system.

13. The system of claim 12, wherein at least one predictive model is a combination of a data based neural network and a first-principle based CFD model.

14. The system of claim 12, wherein the training data includes a plurality of historical boiler parameters each associated with a plurality of emission readings.

15. The system of claim 12, further comprising at least one accessible database for storing the plurality of burner level predictive models.

16. The system of claim 12, wherein the higher level component and the lower level component are in communication over a network.

17. The system of claim 12, wherein both the higher level component and the lower level component are accessible through a user interface.

18. A method for adjusting emission levels within a boiler system, comprising:

receiving a plurality of signals from a plurality of sensors disposed at a plurality of locations in a boiler system, wherein each of the plurality of sensors is associated with at least one of a plurality of burners;

receiving a plurality of boiler parameters and a plurality of burner parameters from the sensors;

updating a model of the boiler system based on at least one of the plurality of signals received;

determining an air flow setting and a fuel flow setting based at least in part on a predictive model for one or more of the plurality of burners;

setting an air flow setting and a fuel flow setting for at least one burner of the plurality of burners based on the determination of the predictive model.

19. The method of claim 18, wherein the step of receiving a plurality of signals from a plurality of sensors disposed at a plurality of locations in a boiler system includes receiving signals from carbon monoxide (CO) sensors, loss of ignition (LOI) sensors, and temperature sensors.

20. The method of claim 18, wherein the step of determining an air flow setting and a fuel flow includes using a predictive model selected from the group consisting of a data driven neural network model, a first principle based Computational Fluid Dynamics (CFD) model, and a hybrid model including both neural network model and CFD model components.

* * * * *